US006155319A

United States Patent [19]

Giugliano et al.

[11] Patent Number: 6,155,319

[45] Date of Patent: Dec. 5, 2000

[54] UNIT FOR JOINING PAPER SHEETS TOGETHER IN CORRUGATED BOARD MANUFACTURING EQUIPMENT

[75] Inventors: Rossi Giugliano, Lesmo; Rossi Renato, Biassono; Pompeo F. Lucca, Merate, all of Italy

[73] Assignee: Agnati S.p.A., Vimercate, Italy

[21] Appl. No.: 09/309,300

[22] Filed: May 11, 1999

[30] Foreign Application Priority Data

May 11, 1998 [IT] Italy ..... SV98A0027

[51] Int. Cl.[7] ..... B31F 1/28

[52] U.S. Cl. ..... 156/471; 156/470; 156/472; 156/205; 156/208; 156/210

[58] Field of Search ..... 156/462, 470, 156/471, 472, 473, 205, 208, 210; 29/895, 895.3, 895.32; 492/20, 41, 48, 59, 60, 49

[56] References Cited

U.S. PATENT DOCUMENTS

| | | | |
|---|---|---|---|
| 3,382,133 | 5/1968 | Healy . | |
| 3,527,638 | 9/1970 | Sonnichsen . | |
| 3,694,300 | 9/1972 | Small | 161/127 |
| 5,628,865 | 5/1997 | Marschke . | |
| 5,681,422 | 10/1997 | Marschke | 156/472 |

FOREIGN PATENT DOCUMENTS

| | | |
|---|---|---|
| 1 511 062 | 9/1970 | Germany . |
| 39 03 683 | 8/1990 | Germany . |
| 40 06 003 | 3/1991 | Germany . |

*Primary Examiner*—Michael W. Ball
*Assistant Examiner*—Jessica Rossi
*Attorney, Agent, or Firm*—James Creighton Wray; Meera P. Narasimhan

[57] ABSTRACT

A unit for joining paper sheets together in corrugated board manufacturing equipment comprises at least one toothed or corrugated roll (1), which is mounted in such a way as to rotate about its axis; means (5, 6) for feeding and pressing at least one flat paper sheet (C2), which interact with the toothed or corrugated roll (1) in laying said flat sheet (C2) over the corrugated paper sheet (C0) conveyed by said toothed or corrugated roll (1) and gluing means (4) which apply adhesive on one of the sheets. According to the invention, the means for feeding/pressing the flat paper sheet (C2) against the corrugated paper sheet (C0) on the toothed or corrugated roll (1) consists of a roll (6) which is mounted in such a way as to rotate about its axis and parallel to the toothed or corrugated roll (1) and which is made, at least at its periphery (106) of a layer of natural or synthetic fibers or compacted blends thereof, having a certain compressibility and/or deformability.

13 Claims, 2 Drawing Sheets

UNIT FOR JOINING PAPER SHEETS TOGETHER IN CORRUGATED BOARD MANUFACTURING EQUIPMENT

BACKGROUND OF THE INVENTION

A unit for joining a flat liner paper sheet to a corrugated paper sheet in corrugated board manufacturing machines, comprising:

a) at least one toothed or corrugated roll, which is mounted in such a way as to rotate about its axis and which drags a corrugated paper sheet in a position partly adhering to its perimetral surface.

b) means for feeding and pressing at least one flat paper sheet, which interacts with the toothed or corrugated roll in laying the flat paper sheet over the corrugated paper sheet, conveyed by said toothed or corrugated roll;

c) gluing means, arranged in such a way as to apply adhesive to one of the sheets to be joined at least before the latter are mutually compressed.

The fabrication of corrugated board substantially provides a step in which a paper sheet, or similar is corrugated and further, the superposition of a flat paper sheet thereto, which is anchored to the corrugated sheet by gluing and mutual compression using several known devices.

A first device provides means for feeding and pressing the flat paper sheet against the corrugated paper sheet, in the form of a pressure roll oriented parallel to the toothed and corrugated roll and rotatable in the counter-rotating direction, which pressure roll is tangent to the toothed or corrugated roll. The toothed or corrugated roll, at least its outer ring gear is generally made of steel, as well as the pressure roll. In this way, when each tooth comes into a tangent position with respect to the shell of the pressure roll, a compressing action is readily exerted on the paper sheets interposed therebetween, having a sort of striking effect, and involving a change in the appearance of the hard paper sheet which forms the exposed face of the product. In the jargon of the field, this mark is defined as glazing deformation of the paper surface or also bright line due to the brighter aspect of paper where the mark of the compressing action is.

An alternative system provides means for feeding and pressing the flat paper sheet against the corrugated paper sheet, gearing with the toothed or corrugated roll, in the form of a feeding/pressing belt, having a predetermined tension and following the shell surface of the toothed or corrugated roll for a certain angular width, while being in contact therewith, and being complementarily deformed, the two paper sheets being interposed therebetween. The feeding/pressing belt exerts a more uniform compression action on the two sheets avoiding, thanks to a certain elasticity and compliance, the localized peaks of pressure caused by the teeth or corrugations of the toothed or corrugated roll. However, in this case, while no buckling effect nor surface mark is produced on the flat sheet, the two sheets are often feebly glued, thus causing them to be easily separated.

SUMMARY OF THE INVENTION

Therefore, the invention has the object to improve a unit of the type described hereinbefore, so that the drawbacks of the well-known units, as explained above, may be avoided, and a strong and resistant link between the two paper sheets may be obtained, thus preventing the presence or formation of prints due to the mutual compression thereof.

The invention is based on the acknowledgement that, in order that the tips of the corrugated sheet may be effectively glued to the flat sheet, the contact areas between the two sheets have to be anyway compressed quickly and with a certain considerable force prior to the substantial initial hardening or drying reaction of the adhesive applied between said contact areas, all this being substantially aimed at allowing the adhesive to be absorbed or to penetrate relatively deeply in the material of the two sheets.

The invention achieves the above objects by providing that the means for feeding/pressing the flat paper sheet against the corrugated paper sheet on the toothed or corrugated roll consists of a roll mounted in such a way as to rotate about its axis and parallel to the toothed or corrugated roll, as well as tangent thereto, which roll is pushed against the toothed or corrugated roll and is made, at least at its periphery, of a layer of natural or synthetic fibers, or of blends thereof, having a certain compressibility or deformability.

Particularly, the invention provides that the peripheral shell of the feed/pressure roll is made of a layer of paper, particularly of papier-mâché.

Alternatively, feed/pressure rolls having a plastic outer shell may be used.

Especially, rolls like those currently in use for other purposes in textile industry may be used.

According to a preferred embodiment, the feed/pressure roll is stressed against the toothed or corrugated roll by a pressure roll parallel thereto, which is loaded to a predetermined extent against the first feed/pressure roll on the side diametrically opposite or substantially diametrically opposite to that of the toothed or corrugated roll.

The rolls are all counter-rotating and when a second pressure roll, generally made of metal, is provided, the flat sheet is also passed between said second and said first pressure rolls before passing between the latter and the toothed or corrugated roll for being coupled to the corrugated sheet.

Thanks to the first feed/pressure roll, having a shell made of a material which is compressible at least to a predetermined extent, it is possible to exert considerable compression peaks on the two paper sheets with no change, at least visibly, affecting the outer surface of the flat sheet. This is due both to the fact that the surface of the shell of the first feed/pressure roll, for its being slightly compressible, is at least slightly penetrated, or rather deformed by the toothed or corrugated roll, hence the pressure is distributed not on the apex of a single tooth but at least on two teeth. Moreover, the material which forms the peripheral shell of the first feed/pressure roll is similar, regarding hardness and other properties, to the paper material forming the sheet.

Therefore, thanks to the invention, sudden mutual compression forces between the two sheets may be exerted, with pressure values far above those obtainable with the well-known devices, and with no undesired marks being visible on the sheets.

The invention also relates to further characteristics, which form the subject of the dependent claims.

The characteristics of the invention, and the advantages derived therefrom will be more apparent from the following description of an embodiment, shown, by way of a non-restricting example, in the accompanying drawings, in which:

DETAILED DESCRIPTION

Figure 1:
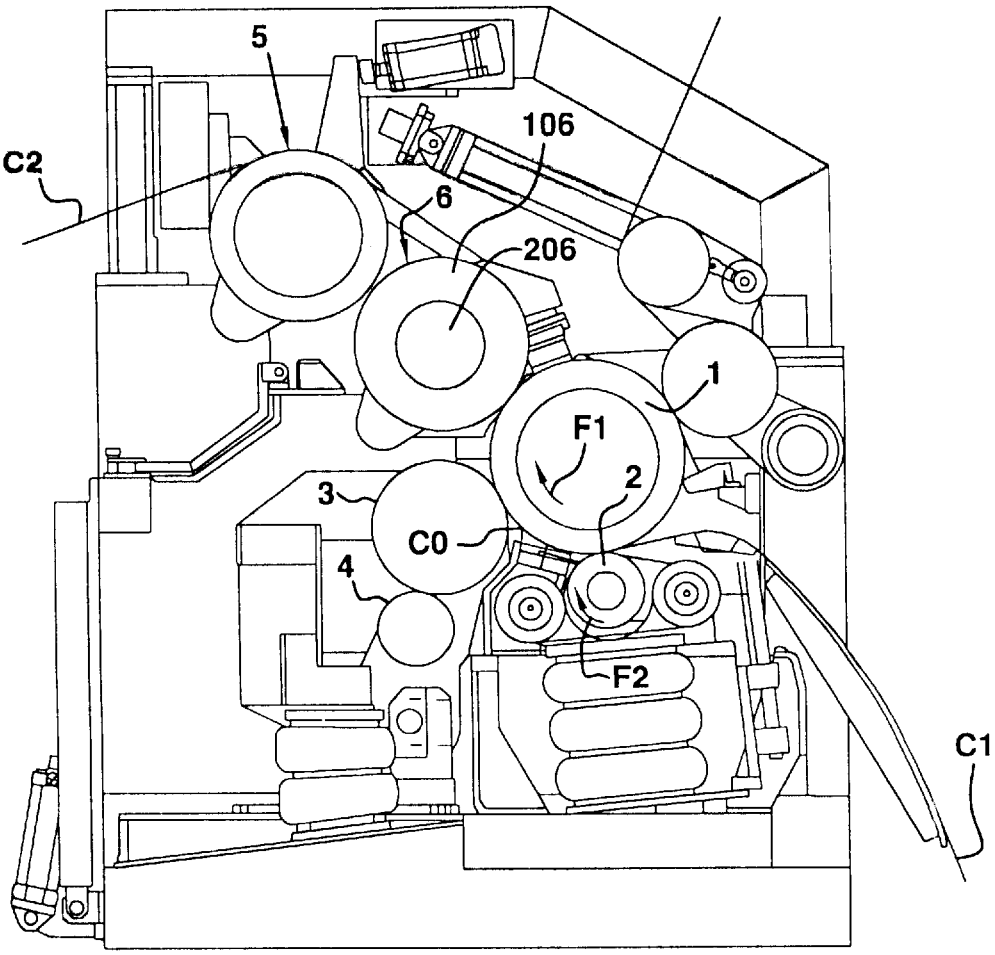
FIG. 1 is a schematic side elevational view of the unit according to the invention.
Figure 2:
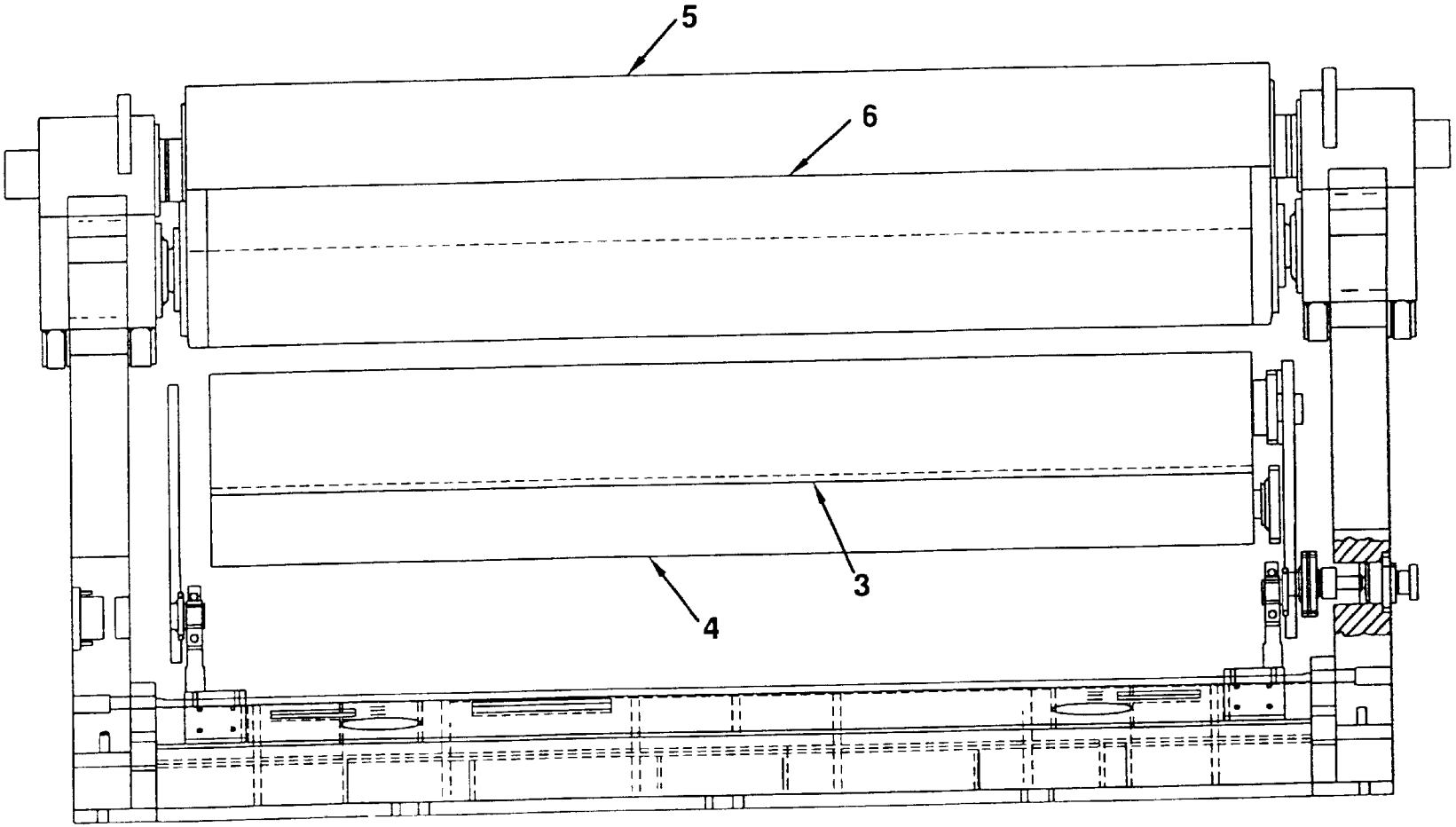
FIG. 2 is a view of the unit as shown in FIG. 1 the toothed roll having been omitted on the feed/pressure rolls.

Referring to the figures, a unit for the continuous fabrication of corrugated board, i.e. for coupling a flat paper sheet with a corrugated paper sheet, which has been obtained by processing a flat paper sheet, comprises a section for corrugating a flat paper sheet, consisting of a pair of corrugator rolls, an upper one, indicated as 1, having the greater diameter, and a lower one 2, having the smaller diameter. The two corrugator rolls 1, 2 have a parallel orientation and are substantially tangent to each other. They have peripheral teeth, having an axial orientation. The peripheral teeth of the two rolls 1, 2 are geared with each other. The upper roll 1 is mounted with its axis in a steady position, whereas the lower corrugator roll 2 may be pushed against the upper roll 1, with predetermined pressure. This may be obtained by any arrangement whatever. Particularly, with reference to the previous example, the lower corrugator roll is supported by a plurality of belts, arranged along its axial extension, so as to form a cradle, and which belts may be pushed with a stronger or feebler force towards compressing the lower roll 2 against the upper corrugator roll 1. The two corrugator rolls 1, 2 are counter-rotating following the arrows F1 and F2 and the first paper sheet C1 is fed therebetween from the bottom and the right of FIG. 1. The passage between the two mutually engaged toothings causes the corrugation of the sheet. At the exit of the contact area of the two corrugator rolls 1, 2 the corrugated sheet C0 is kept engaged with and laid over the surface of the upper corrugator roll 1 and passes through a gluing unit 3, also consisting of a roll, appropriately constructed for that purpose and known per se. The gluing roll applies a layer of adhesive on the tips of the corrugations of the corrugated sheet C0. The adhesive is drawn by a proportioning roll, also known per se and indicated with numeral 4 in FIG. 1. A second paper sheet C2 is fed from the top and opposite to the paper sheet C1, and is dragged between two counter-rotating rolls 5, 6. Both rolls 5, 6 are parallel to each other and to the upper corrugator roll 1 and are in contact, while the intermediate roll 6 is tangential to the upper corrugator roll 1. A first pressure roll 6 is provided between the upper corrugator roll 1 and the second pressure roll 5, which is loaded against the first pressure roll and pushes it with a predetermined force against the upper corrugator roll 1. The first pressure roll 6, or at least its peripheral layer 106, is made of an elastic material. Particularly, said material may be papier-mache, plastic or other types of fibers fit for providing the peripheral surface of the first pressure roll 6 with a certain compliance and deformability. Advantageously, the material which forms the outer peripheral layer 106 is substantially or approximately of the same type as paper, or anyway it does not have an excessively different hardness. The core 206 may consist of a roller made of steel or other metal. Particularly, rolls with a peripheral layer made of papier-mache or plastic, commonly used in textile industry may be advantageously used as pressure rolls 6.

The second pressure roll 5 is made of metal, preferably steel and possibly, advantageously even heated. The three rolls 5, 6, 1 are in line so that their respective axes are disposed substantially on a single common plane. The second paper sheet C2 passes at first between the first and the second pressure rolls 5, 6 and then around the first pressure roll 6, between the latter and the upper corrugator roll 1, together with the corrugated sheet C0, whereon the adhesive has been applied.

The two sheets C0 and C2 are superposed and, thanks to the pressing action between the two rolls 5, 1 and also to successive stretching means, they are glued to each other.

In the contact area between the upper corrugator roll 1 and the first pressure roll 6, the latter becomes slightly deformed, whereby a sort of deformation of the pressing roll occurs, having such an extension that the compression force is not discharged on a single tooth of the upper corrugator roll 1, but on a certain number of teeth, for example two or more teeth. By this arrangement, although a peak of mutual compression is exerted on the two sheets, this peak is not discharged on a single point corresponding to the tip of one toothing. Therefore, particularly the sheet C2, which is exposed, is not subjected to deformations, marking or no visible marks due to processing remain visible thereon. The exterior aspect of the sheet C2 is also preserved thanks to the fact that the pressure roll 6 is made of a material which has a surface hardness at least comparable with that of the paper material forming the sheet C2. Thanks to the first pressure roll 6, even considerably higher peaks of pressure may be applied on the gluing areas of the two sheets C2 and C0, with no visible marks of damages, structural or exterior changes appearing on the paper in the zones subject to compression. These peaks of mutual compression of the two sheets C2, C0 in the contact areas where adhesive is provided are necessary, according to the most widespread theories, to help the adhesive to spread more deeply in the surface layers of the paper material to be glued, before the start of the drying or setting reaction of the adhesive, thus improving the gluing resistance.

Further, thanks to the elasticity and deformability of the first pressure roll 6, any vibrations, which would be transmitted to the structure due to the steel teeth of the corrugator roll, beating against the surface of the pressure roll, also made of steel, are dampened. When these vibrations are dampened, advantages are also obtained in critically reducing the intensity of the operational noise.

Obviously, the invention is not limited to what has been described and illustrated herein. Therefore, particularly, the pressure roll 6, made of an elastic or deformable material, does not have to be provided in combination with the particular corrugator unit illustrated herein, but may be also used in combination with other types of corrugator units. Moreover, the second pressure roll, also named calender 5 may be also omitted, or replaced by a roll having the same construction as that of the first pressure roll 6 or anyway similar thereto.

All this may be provided without departure from the guiding principle disclosed above and claimed below.

What is claimed is:

1. A unit for joining a flat liner paper sheet to a corrugated paper sheet in corrugated board manufacturing machines, comprising:

a) at least one toothed or corrugated roll (1), which is mounted in such a way as to rotate about its axis and which drags a corrugated paper sheet (C1, C0) in a position partly adhering to its perimetral surface, b) means (5, 6) for feeding and pressing at least one flat paper sheet (C2), which interacts with the toothed or corrugated roll (1) in laying the flat paper sheet (C2) over the corrugated paper sheet (C0), conveyed by said toothed or corrugated roll (1);

c) gluing means (4), arranged in such a way as to apply adhesive to one of the sheets (C0) at least before the two sheets (C2, C0) are joined and compressed together;

characterized in that the means for feeding/pressing the flat paper sheet (C2) against the corrugated paper sheet (C0) on the toothed or corrugated roll (1) consists of a roll (6) mounted in such a way as to rotate about its axis and parallel to the toothed or corrugated roll (1), as well as tangent thereto, which roll (6) is pushed against the toothed or corrugated roll (1) and is made, at least at its periphery (106), of a layer of natural or synthetic fibers, or of compacted blends thereof, having a certain compressibility and/or deformability.

2. A unit as claimed in claim 1, characterized in that the periphery (106) of the feed/pressure roll (6) is made of a layer of paper.

3. A unit as claimed in claim 2, wherein the paper layer is papier-mache.

4. A unit as claimed in claim 1, characterized in that the periphery (106) of the feed/pressure roll (6) is made of plastic.

5. A unit as claimed in claim 1, characterized in that the feed/pressure roll may comprise a core (206) and one or more cylindrical layers, one over the other, made of different materials and having different mechanical properties.

6. A unit as claimed in claim 1, characterized in that the feed/pressure roll (6) is stressed against the toothed or corrugated roll (1) by a second pressure roll (5) parallel thereto, which is loaded to a predetermined extent against the first feed/pressure roll (6) on the side opposite to that of the toothed or corrugated roll (1) so that their respective axes are disposed substantially on a single common plane.

7. A unit as claimed in claim 6, characterized in that the second pressure roll (5) has the same construction as the first feed/pressure roll (6).

8. A unit as claimed in claim 6, characterized in that the second pressure roll (5) is made of metal, and is preferably heated.

9. A unit as claimed in claim 8, wherein the metal is steel.

10. A unit as claimed in claim 1, characterized in that the rolls (1, 5, 6) are all counter-rotating and when a second pressure roll (5), generally made of metal, is provided, the flat sheet (C2) is also passed between said second (5) and said first (6) pressure rolls before passing between the latter and the toothed or corrugated roll (1) for being coupled to the corrugated sheet (C0).

11. A unit as claimed in claim 1, characterized in that the corrugated or toothed rolls (1, 2) form a corrugated sheet (C0) from a flat paper sheet (C1) a corrugated sheet (C0) from a flat paper sheet (C1).

12. A unit as claimed in claim 1, characterized in that the fibers forming at least the peripheral layer (106) of the feed/pressure roll (6) have a hardness which is substantially similar to that of the paper material (C2) in use.

13. A unit as claimed in claim 1, characterized in that the peripheral layer (106) of the feed/pressure roll (6) is so deformable that, in the contact area, the toothed or corrugated roll (1) penetrates the feed/pressure roll (6), slightly deforming it, in such a way that more than one tooth comes into contact with the surface thereof, the two sheets (C2, C0) being interposed therebetween.

* * * * *

UNITED STATES PATENT AND TRADEMARK OFFICE

CERTIFICATE OF CORRECTION

PATENT NO. : 6,155,319
DATED : December 5, 2000
INVENTOR(S) : Giugliano Rossi, Renato Rossi, Flavio Pompeo Lucca It is certified that error appears in the above-identified patent and that said Letters Patent is hereby corrected as shown below:

Title page,
Under item [19], "Giugliano" should be "Rossi";

Item [75], "Rossi Giugliano" should be -- Giugliano Rossi --; "Rossi Renato" should be -- Renato Rossi --; "Pompeo F. Lucca" should be -- Flavio Pompeo Lucca --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*